US011867103B2

(12) United States Patent
Krusch

(10) Patent No.: US 11,867,103 B2
(45) Date of Patent: Jan. 9, 2024

(54) RESONATOR, METHOD FOR PRODUCING SUCH A RESONATOR, AND COMBUSTOR ARRANGEMENT EQUIPPED WITH SUCH A RESONATOR

(71) Applicant: Siemens Energy Global GmbH & Co. KG, Munich (DE)

(72) Inventor: Claus Krusch, Essen (DE)

(73) Assignee: Siemens Energy Global GmbH &Co. KG, Munich (DE)

( * ) Notice: Subject to any disclaimer, the term of this patent is extended or adjusted under 35 U.S.C. 154(b) by 200 days.

(21) Appl. No.: 17/602,572

(22) PCT Filed: Mar. 16, 2020

(86) PCT No.: PCT/EP2020/057044
§ 371 (c)(1),
(2) Date: Oct. 8, 2021

(87) PCT Pub. No.: WO2020/212039
PCT Pub. Date: Oct. 22, 2020

(65) Prior Publication Data

US 2022/0178284 A1 Jun. 9, 2022

(30) Foreign Application Priority Data

Apr. 17, 2019 (DE) ..... 10 2019 205 540.0

(51) Int. Cl.
*F23R 3/60* (2006.01)
*F01N 1/02* (2006.01)
*F23R 3/00* (2006.01)

(52) U.S. Cl.
CPC ..... *F01N 1/023* (2013.01); *F23R 3/002* (2013.01); *F23R 3/60* (2013.01)

(58) Field of Classification Search
CPC ..... F01N 1/023; F01N 1/026; F23R 2900/00014; F23R 3/002; F23R 3/60
See application file for complete search history.

(56) References Cited

U.S. PATENT DOCUMENTS 5,291,733 A * 3/1994 Halila ..... F23R 3/60 60/753
6,547,210 B1 4/2003 Marx et al.
(Continued)

FOREIGN PATENT DOCUMENTS

CN 106605103 A 4/2017
CN 107796015 A 3/2018
(Continued)

OTHER PUBLICATIONS

PCT International Search Report and Written Opinion of International Searching Authority dated Jul. 30, 2020 corresponding to PCT International Application No. PCT/EP20201057044 filed Mar. 16, 2020—previously uploaded.
(Continued)

*Primary Examiner* — Steven M Sutherland
(74) *Attorney, Agent, or Firm* — Wolter Van Dyke Davis, PLLC

(57) ABSTRACT

An annular resonator with a multiplicity of perforations for installation into a combustor arrangement of a static gas turbine installation, wherein the resonator is produced from refractory ceramic. A combustor arrangement for a gas turbine installation with a combustor unit, has a combustor, with a transfer line, which is arranged downstream of the combustor unit and which is designed to conduct hot gas generated by the combustor to a turbine, and with at least one resonator.

11 Claims, 4 Drawing Sheets

(56) References Cited

U.S. PATENT DOCUMENTS

| | | | |
|---|---|---|---|
| 7,926,278 | B2 | 4/2011 | Gerendas et al. |
| 9,003,800 | B2 | 4/2015 | Akamatsu et al. |
| 2002/0088233 | A1 | 7/2002 | Ohnishi |
| 2007/0283700 | A1 | 12/2007 | Gerendas et al. |
| 2011/0220433 | A1 | 9/2011 | Nakamura et al. |
| 2012/0167574 | A1 | 7/2012 | Uskert |
| 2015/0113990 | A1 | 4/2015 | Eroglu |
| 2015/0367953 | A1 | 12/2015 | Yu et al. |
| 2016/0023375 | A1 | 1/2016 | Uram |
| 2017/0276350 | A1 | 9/2017 | Schilp et al. |
| 2018/0010798 | A1 | 1/2018 | Pettersson et al. |
| 2018/0066847 | A1 | 3/2018 | Stoia et al. |
| 2018/0106163 | A1 | 4/2018 | Hoffman |

FOREIGN PATENT DOCUMENTS

| | | | | |
|---|---|---|---|---|
| DE | 102006026969 | A1 | 12/2007 | |
| DE | 102006053277 | A1 | 5/2008 | |
| DE | 102015216772 | A1 | 3/2017 | |
| EP | 3309457 | A1 * | 4/2018 | ..... F01D 25/04 |
| GB | 2309296 | A | 7/1997 | |
| JP | S6038530 | A | 2/1985 | |
| JP | H024129 | A | 1/1990 | |
| JP | 2001254634 | A | 9/2001 | |
| JP | 2018087681 | A | 6/2018 | |

OTHER PUBLICATIONS

International search report and written opinion dated Jul. 30, 2020 for corresponding PCT/EP2020/057044.

* cited by examiner

RESONATOR, METHOD FOR PRODUCING SUCH A RESONATOR, AND COMBUSTOR ARRANGEMENT EQUIPPED WITH SUCH A RESONATOR

CROSS REFERENCE TO RELATED APPLICATIONS

This application is the US National Stage of International Application No. PCT/EP2020/057044 filed 16 Mar. 2020, and claims the benefit thereof. The International Application claims the benefit of German Application No. DE 10 2019 205 540.0 filed 17 Apr. 2019. All of the applications are incorporated by reference herein in their entirety.

FIELD OF INVENTION

The invention relates to an annular resonator having a multiplicity of perforations for installation in a combustor arrangement of a static gas turbine installation. The invention furthermore relates to a method for producing a resonator according to the invention, and to a combustor arrangement for a gas turbine installation, comprising a combustor unit having a combustor, a transition line, which is arranged downstream of the combustor unit and is designed to direct the hot gas produced by the combustor to a turbine, and at least one such resonator.

BACKGROUND OF INVENTION

Combustor arrangements are used in gas turbine installations to generate hot gas and to direct it to the turbine inlet. For this purpose, they comprise, in addition to a combustor unit, a transition line designed as a pipe, which is also referred to as a "transition" in specialist circles. The transition line is subjected to high thermal stress during operation of the gas turbine installation. Accordingly, it is produced from a material resistant to high temperatures, usually from a thin-walled nickel-based material with internal cooling ducts, and has an inner layer system for thermal insulation (TBC+MCrAlY). In order to reduce acoustic combustion oscillations, there is a known practice of arranging at least one annular resonator, which is produced from metal, behind the flame region in the "basket" of the combustor unit. The resonator is technically a weak point of the combustor arrangement since it regularly exhibits cracks and limits the service life of the "basket". The new production and the replacement of a resonator are very complex and cost-intensive. Taking into account the fact that, owing to the ever-increasing demands on gas turbine installations, a further intensification of the reporting situation is to be expected, it is an object of the present invention to make the maintenance of combustor arrangements simpler and cheaper.

SUMMARY OF INVENTION

To achieve this object, the present invention provides a resonator of the type mentioned at the outset, which is characterized in that it is produced from refractory ceramic. As a result, at the temperatures prevailing during operation of a combustor arrangement, the resonator has a significantly lower tendency for cracking, thereby significantly reducing the maintenance effort and costs.

Advantageously, the resonator has an outer circumferential surface which tapers conically in the axial direction, allowing it to be inserted into an annular metallic casing structure having a lateral surface which likewise tapers conically and can be secured on said casing structure.

A multiplicity of spring elements acting in the radial direction is advantageously arranged on the outer circumferential surface of the resonator. Such spring elements permit radial and axial bracing of the resonator when the latter is inserted into a metallic casing structure, while maintaining an annular gap between the resonator and the casing structure, enabling thermal expansion differences to be compensated and the resonator to be fixed with limited force under all operating conditions.

According to one embodiment of the present invention, the spring elements are leaf springs which extend in the axial direction and are bent radially outward. In this way, a simple and inexpensive construction is achieved.

The spring elements advantageously have uniform spacings from one another in the circumferential direction, allowing centered positioning of the resonator within the casing structure.

The resonator can be of one-piece design or can be composed of a plurality of ring segments.

Furthermore, the present invention provides a method for producing a resonator according to the invention, in which, as part of the primary forming process of the annular resonator, advantageously additively produced mold inserts are used to form the perforations. During the production of the resonator, the perforations can be matched geometrically to desired damping frequencies. For this purpose, it is possible to vary parameters, such as the hole area ratio, i.e. the ratio of all hole areas to the total area, the resonator thickness, the radius of the holes or the like. The size of the gap between the resonator and a metallic casing structure selected during the mounting of the resonator also has an influence on the damping frequency.

Moreover, the present invention proposes a combustor arrangement for a gas turbine installation, comprising a combustor unit having a combustor, a transition line, which is arranged downstream of the combustor unit and is designed to direct the hot gas produced by the combustor to a turbine, and at least one resonator according to the invention.

Preferably, the at least one resonator is accommodated with radial and axial prestress in an annular metallic casing structure having a cross section which tapers conically in the downstream direction, wherein spring elements are arranged between the resonator and the casing structure.

Advantageously, the radial and axial prestress is applied via a pressure element, in particular a pressure element of annular design, which is secured releasably on the end of the casing structure, in particular being screwed to the latter. This pressure element thus presses axially against the resonator(s) inserted into a casing structure and subjects the spring elements to the desired prestress.

The casing structure can be formed by the combustor unit or by the transition line itself or can be provided as a separate component, which is arranged between the combustor unit and the transition line.

BRIEF DESCRIPTION OF THE DRAWINGS

Further features and advantages of the present invention will become clear from the following description with reference to the appended drawing. In the drawing.

DETAILED DESCRIPTION OF INVENTION

Figure 1:
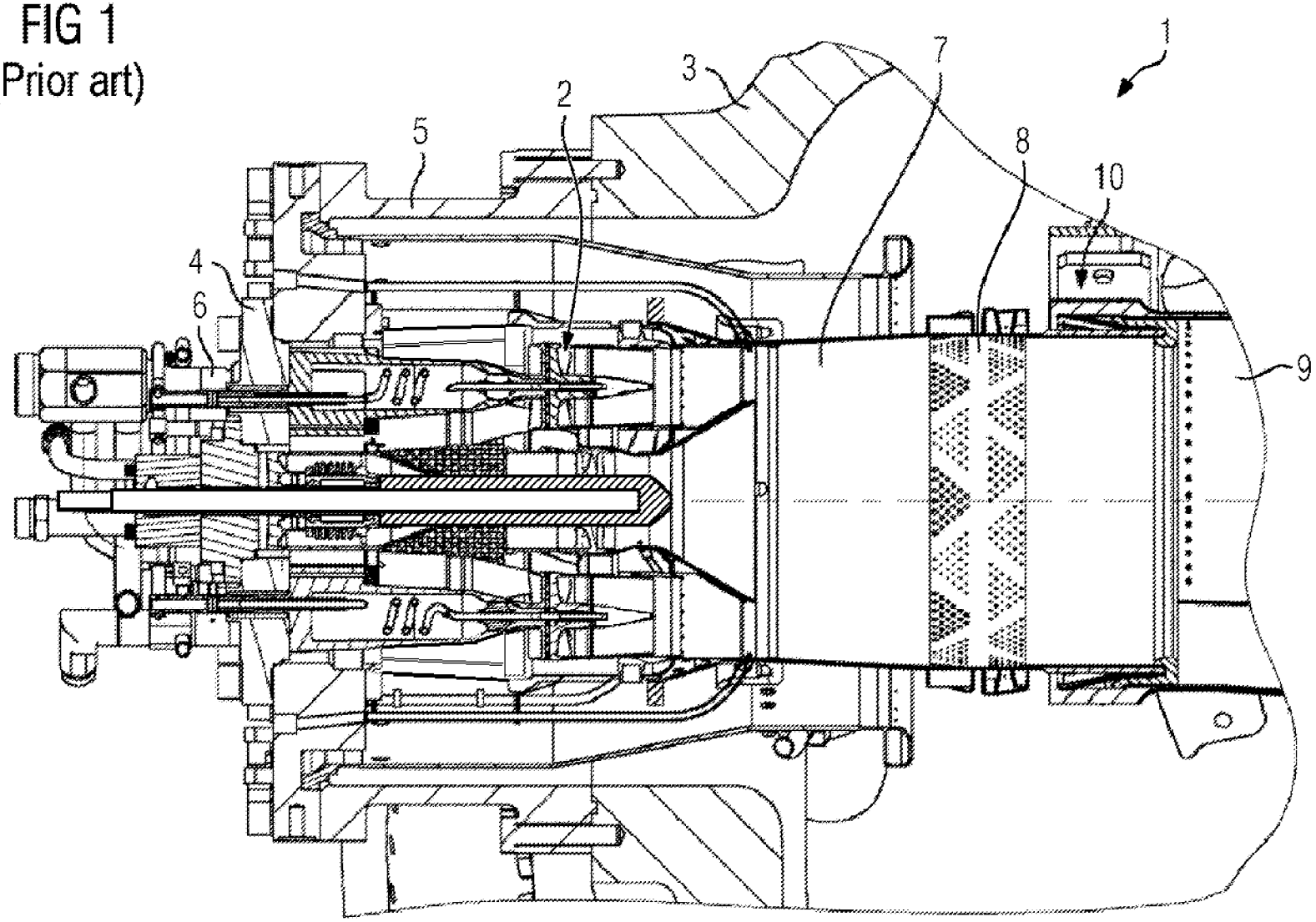
FIG 1 (Prior art)
FIG. 1 is a sectional view of a region of a known gas turbine installation.

Identical reference numerals relate below to similar components or component sections.

FIG. 1 shows a region of a known gas turbine installation 1, in which a combustor unit 2 is inserted into a housing 3 of the gas turbine installation 1. The combustor unit 2 is connected via a flange 4 to a connecting housing 5, which in turn is screwed to the housing 3. In principle, however, the flange 4 can also be secured directly on the housing 3, and the connecting housing 5 can be dispensed with accordingly. The combustor unit 2 comprises a combustor 6 and a tubular combustion chamber 7, which adjoins the latter downstream and is frequently also referred to as a "basket". A metallic resonator 8 is provided behind the flame region of the combustor 6 in the region of the combustion chamber 7, said resonator being provided for the purpose of reducing acoustic combustion oscillations. The outlet end of the combustion chamber 7 is connected to an inlet end of a transition line 9, also referred to as a "transition", which is held on the housing 3 by means of an adjusting and fixing device 10 and is designed to direct the hot gas produced by the combustor 6 to a turbine of the gas turbine arrangement 1, which turbine is positioned downstream and is not illustrated in the present case. The combustor unit 2 and the transition line 9 together form a combustor arrangement. The gas turbine installation 1 comprises a plurality of these combustor arrangements, which supply the turbine with hot gas.

The combustor arrangements are subjected to high thermal stress during operation of the gas turbine installation 1. The high temperatures lead to cracks in the resonators 8, for which reason the combustion chambers 7 have to be repaired or replaced regularly. This is very time-consuming and cost-intensive.

Figure 2:
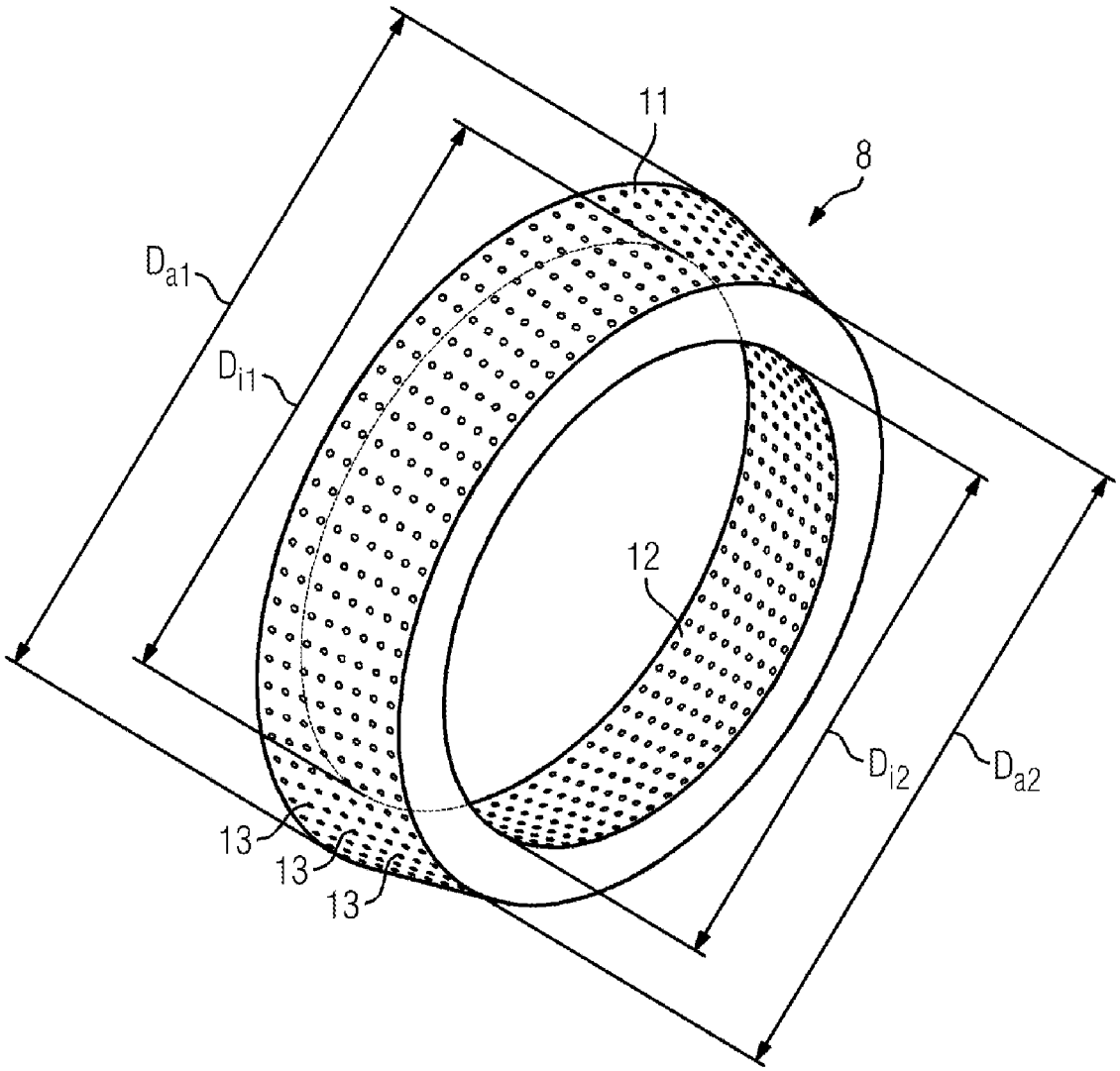
FIG. 2 is a perspective view of a resonator according to a first embodiment of the present invention.

FIG. 2 shows an annular resonator 8 according to a first embodiment of the present invention, which is produced from refractory ceramic. The resonator 8 has an outer circumferential surface 11 which tapers conically in the axial direction A from an outer diameter $D_{a1}$ to an outer diameter $D_{a2}$, and an inner circumferential surface 12 which in the present case extends parallel to the outer circumferential surface 11 and thus likewise tapers conically in the axial direction from an inner diameter $D_{i1}$ to an inner diameter $D_{i2}$. A multiplicity of perforations 13 is formed on the outer circumferential surface 11. During the production of the resonator 8, the size, number, distribution and shape of the individual perforations 13 can be freely selected in order to achieve a desired damping frequency. The perforations 13 are advantageously produced as part of the primary forming process of the resonator 8, using additively produced mold inserts, it being possible, of course, in principle also to use other or supplementary production techniques.

Figure 3:
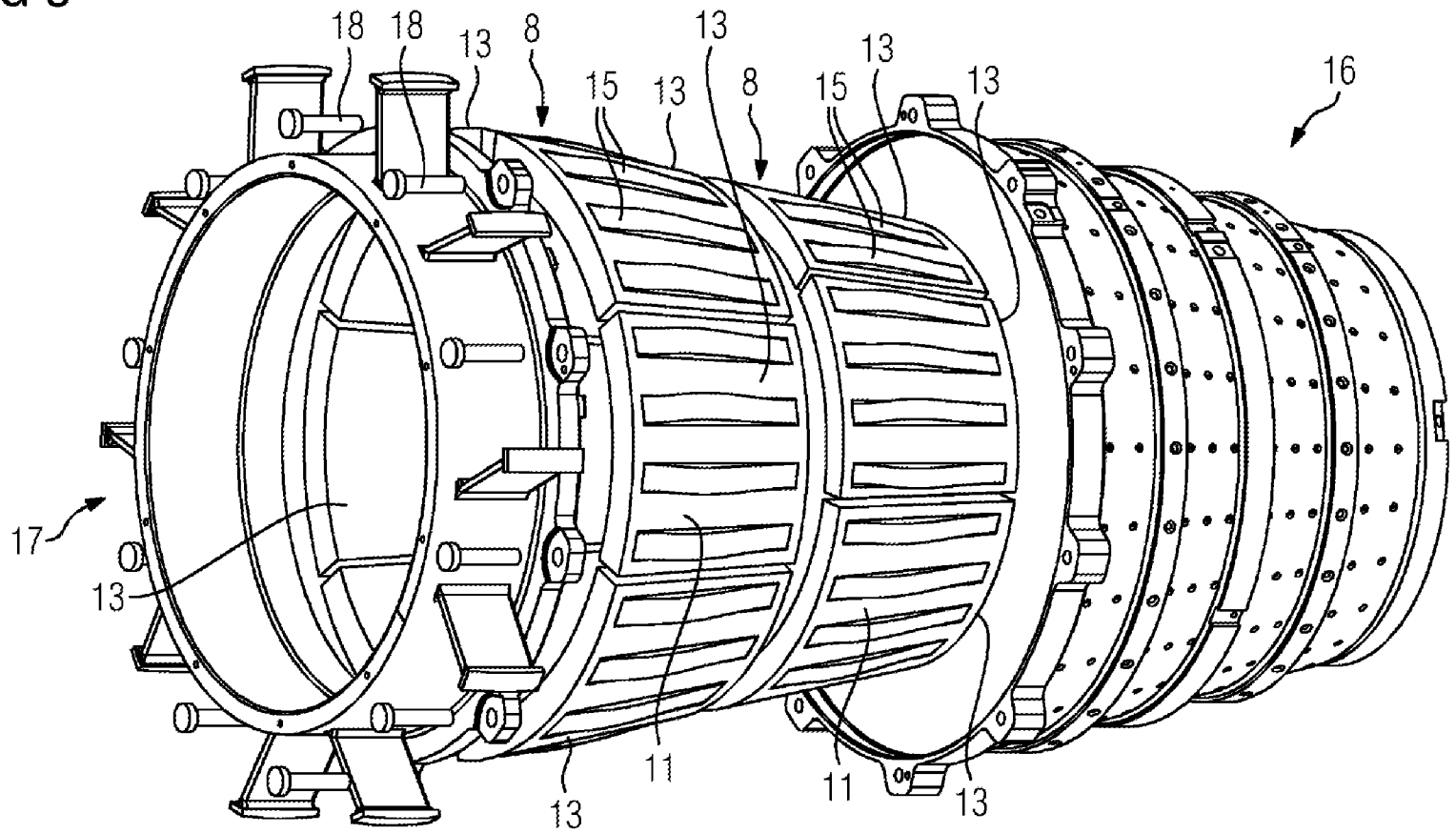
FIG. 3 is an exploded perspective view of a partial region of a combustor arrangement according to the invention which has resonators according to a second embodiment of the present invention.
Figure 4:
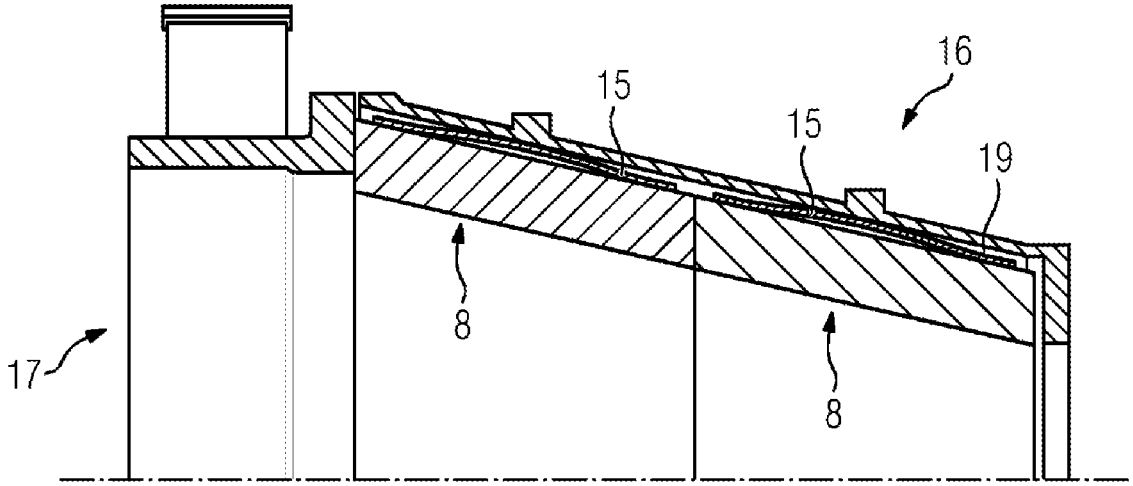
FIG. 4 is a sectional view of the arrangement shown in FIG. 2 in the assembled state.

FIGS. 3 and 4 show resonators 8 according to a second embodiment of the present invention, which are produced from refractory ceramic and provided with perforations 13 analogously to the resonator 8 shown in FIG. 2. One difference is that the resonators 8 illustrated in FIG. 3 are not in one piece but are composed of a plurality of ring segments 14. A multiplicity of spring elements 15 acting in the radial direction is positioned on the outer circumferential surface 11 and, in the present case, these are designed as leaf springs which extend in the axial direction and are bent radially outward and are arranged in a uniformly distributed manner over the outer circumferential surface 11. To accommodate the spring elements 15, depressions can be formed in the outer circumferential surface 11 of the resonator 8, although this is not absolutely necessary. During their installation, the two resonators 8 illustrated in FIG. 3 are inserted axially one behind the other with the respectively smaller outer diameter $D_{a2}$ in front into a metallic casing structure 16, with the result that the spring elements 15 come into engagement with the inner wall of the casing structure 16. The resonators 8 are then pushed further into the casing structure 16 by means of a pressure element 17, which in the present case is of annular design, counter to the spring force of the spring elements 15, whereupon the pressure element 17 is secured on the end of the casing structure 16 using fastening screws 18. In this way, the resonators 8 are fixed while maintaining an annular gap 19 between the resonators 8 of the casing structure 16 and a radial and axial prestress is exerted. Here, the size of the annular gap 19 can be adjusted within certain limits and likewise has an effect on the damping frequency or damping frequencies of the resonators 8. In principle, the casing structure 16 can form a part of the combustion chamber 7 of the combustor unit 2 or a part of the transition line 9 or, as shown in FIGS. 3 and 4, can be provided as a separate component, which is inserted between the combustor unit 2 and the transition line 9 and is secured thereon.

It should be clear that the resonator 8 illustrated in FIG. 2, like the resonators 8 illustrated in FIGS. 3 and 4, can be mounted using a casing structure 16, spring elements 15 and a pressure element 17.

Although the invention has been illustrated and described more specifically in detail by means of the illustrative embodiment, the invention is not restricted by the examples disclosed, and other variations can be derived therefrom by a person skilled in the art without exceeding the scope of protection of the invention.

The invention claimed is:

1. An annular resonator comprising:

a multiplicity of perforations for installation in a combustor arrangement of a static gas turbine installation, wherein the annular resonator is produced from refractory ceramic and comprises an outer circumferential surface which tapers conically in an axial direction, the annular resonator further comprising a multiplicity of spring elements acting in a radial direction which is arranged on the outer circumferential surface, wherein the multiplicity of spring elements have uniform spacings from one another in a circumferential direction.

2. The annular resonator as claimed in claim 1, wherein the multiplicity of spring elements are leaf springs which extend in anin the axial direction and are bent radially outward.

3. The annular resonator as claimed in claim 1, wherein said annular resonator is composed of a plurality of ring segments.

4. A method for producing an annular resonator as claimed in claim 1, the method comprising:

forming the annular resonator, wherein as part of a primary forming process of the annular resonator, additively produced mold inserts are used to form the multiplicity of perforations.

5. A combustor arrangement for a gas turbine installation, comprising:

a combustor unit having a combustor, a transition line, which is arranged downstream of the combustor unit and is designed to direct hot gas generated by the combustor to a turbine, and at least one annular resonator as claimed in claim 1.

6. The combustor arrangement as claimed in claim 5, wherein the at least one annular resonator is accommodated with radial and axial prestress in an annular metallic casing structure having a cross section which tapers conically in a downstream direction, wherein spring elements are arranged between the at least one annular resonator and the annular metallic casing structure.

7. The combustor arrangement as claimed in claim 6, wherein the radial and axial prestress is applied via a pressure element, which is secured releasably on an end of the annular metallic casing structure.

8. The combustor arrangement as claimed in claim 6, wherein the annular metallic casing structure is formed by the combustor unit or by the transition line or is provided as a separate component, which is arranged between the combustor unit and the transition line.

9. The combustor arrangement as claimed in claim 7, wherein the pressure element is of annular design.

10. The combustor arrangement as claimed in claim 7, wherein the pressure element is screwed to the end of the annular metallic casing structure.

11. A combustor arrangement for a gas turbine installation, comprising:

a combustor unit having a combustor, a transition line, which is arranged downstream of the combustor unit and is designed to direct hot gas generated by the combustor to a turbine, and at least one annular resonator comprising a multiplicity of perforations for installation in the combustor arrangement, wherein the at least one annular resonator is produced from refractory ceramic, wherein the at least one annular resonator is accommodated with radial and axial prestress in an annular metallic casing structure having a cross section which tapers conically in a downstream direction, and wherein spring elements are arranged between the at least one annular resonator and the annular metallic casing structure.

* * * * *